US011639283B2

(12) United States Patent
Birrer et al.

(10) Patent No.: US 11,639,283 B2
(45) Date of Patent: May 2, 2023

(54) FLOOR POSITION DETECTION DEVICE OF AN ELEVATOR INSTALLATION AND METHOD FOR GENERATING A FLOOR SIGNAL

(71) Applicant: Inventio AG, Hergiswil (CH)

(72) Inventors: Eric Birrer, Buchrain (CH); Thomas Hartmann, Kleinwangen (CH)

(73) Assignee: INVENTIO AG, Hergiswil (CH)

( * ) Notice: Subject to any disclaimer, the term of this patent is extended or adjusted under 35 U.S.C. 154(b) by 712 days.

(21) Appl. No.: 16/500,126

(22) PCT Filed: Feb. 22, 2018

(86) PCT No.: PCT/EP2018/054438
§ 371 (c)(1),
(2) Date: Oct. 2, 2019

(87) PCT Pub. No.: WO2018/219504
PCT Pub. Date: Dec. 6, 2018

(65) Prior Publication Data

US 2020/0109026 A1 Apr. 9, 2020

(30) Foreign Application Priority Data

Jun. 2, 2017 (EP) ..... 17174280

(51) Int. Cl.
*B66B 1/34* (2006.01)

(52) U.S. Cl.
CPC ..... *B66B 1/3492* (2013.01)

(58) Field of Classification Search
CPC ... B66B 1/3492; B66B 5/0018; B66B 1/3461; B66B 5/00; B66B 7/1223; B66B 1/34; B66B 5/0037; B66B 5/0031; B66B 5/0006; B66B 3/02; B66B 1/3407; B66B 7/123;

(Continued)

(56) References Cited

U.S. PATENT DOCUMENTS

| | | | | |
|---|---|---|---|---|
| 9,193,563 | B2 * | 11/2015 | Arnold | B66B 1/50 |
| 2015/0344266 | A1 | 12/2015 | Inque et al. | |
| 2016/0039635 | A1 * | 2/2016 | Kangas | B66B 3/02 187/277 |

FOREIGN PATENT DOCUMENTS

| | | | |
|---|---|---|---|
| CN | 1733585 | A | 2/2006 |
| CN | 104071665 | A | 10/2014 |
| CN | 106414294 | A | 2/2017 |

(Continued)

*Primary Examiner* — Marlon T Fletcher
(74) *Attorney, Agent, or Firm* — William J. Clemens; Shumaker, Loop & Kendrick, LLP

(57) ABSTRACT

A floor position detection device of an elevator installation, and a method for generating a floor signal, includes a sensor unit and an evaluation unit for generating the floor signal with two states. The states are "in the range of the floor" and "outside the range of the floor". The sensor unit includes a first Hall effect sensor generating a first floor position characteristic value and a second Hall effect sensor generating a second floor position characteristic value. The evaluation unit generates the floor signal on the basis of a comparison between the first and the second floor position characteristic values. The evaluation unit verifies whether the first and/or second floor position characteristic value is higher than a first threshold value and generates the floor signal on the basis of the result of the verification.

15 Claims, 3 Drawing Sheets

(58) Field of Classification Search
CPC ..... B66B 1/50; B66B 1/3446; B66B 13/00; B66B 13/14
See application file for complete search history.

(56) References Cited

FOREIGN PATENT DOCUMENTS

| | | | | | |
|---|---|---|---|---|---|
| EP | 1621504 | A1 | | 2/2006 | |
| EP | 2489621 | A1 | | 8/2012 | |
| EP | 2325126 | B1 | | 1/2013 | |
| EP | 2516304 | B1 | | 3/2014 | |
| EP | 3025997 | A1 | | 6/2016 | |
| EP | 2310310 | B1 | | 11/2017 | |
| ES | 2468798 | T3 | * | 12/2010 | |
| WO | 2011042612 | A1 | | 4/2011 | |
| WO | WO-2011076533 | A1 | * | 6/2011 | ..... B66B 1/3492 |
| WO | WO-2018219504 | A1 | * | 12/2018 | ..... B66B 1/3492 |

* cited by examiner

FLOOR POSITION DETECTION DEVICE OF AN ELEVATOR INSTALLATION AND METHOD FOR GENERATING A FLOOR SIGNAL

FIELD

The invention relates to a floor position detection device of an elevator installation and a method for generating a floor signal in an elevator installation.

BACKGROUND

The EP 2516304 B1 describes a floor position detection device of an elevator installation having a sensor unit and an evaluation unit for generating a floor signal which has two states. The sensor unit arranged on an elevator car has a total of five Hall effect sensors. In the range of a floor, a permanent magnet is arranged in such a manner that, when approaching the floor, the Hall effect sensors mentioned output a floor position characteristic value which depends on the distance of the corresponding Hall effect sensor from the permanent magnet. Two of the Hall effect sensors are designated as so-called main sensors, whose floor position characteristic values are compared with each other to generate the floor signal. If the two floor position characteristic values of the two main sensors are of the same size and the floor position characteristic values of the other Hall effect sensors meet the specified conditions, the evaluation device changes the state of the floor signal. The other three Hall effect sensors are particularly needed to ensure that the evaluation unit only reacts when the permanent magnet is near the sensor unit.

SUMMARY

By contrast, it is an object of the invention in particular to propose an inexpensive floor position detection device for an elevator installation and a method for generating a floor signal in an elevator installation which can be implemented cost-effectively. According to the invention, this object is solved with a floor position detection device having the features and a method with the features described below.

According to the invention, the floor position detection device of an elevator installation has a sensor unit and an evaluation unit for generating a floor signal which has two states. The floor signal can assume the two states "in the range of the floor" or "outside the range of the floor", wherein further states are also conceivable. The sensor unit has a first Hall effect sensor for generating a first floor position characteristic value and a second Hall effect sensor for generating a second floor position characteristic value. The evaluation unit is intended to generate the floor signal based on a comparison of the first and second floor position characteristic values. According to the invention, the evaluation unit is intended to verify whether the first and/or second floor position characteristic value is greater than a first threshold value and to generate the floor signal based on the result of the mentioned verification.

The combination of comparing the two floor position characteristic values and verifying whether one or both floor position characteristic values are greater than a first threshold value provides a cost-effective floor position detection device that also allows accurate determination of the position of the elevator car relative to a floor of the elevator installation. By comparing the first and/or second floor position characteristic value with the mentioned first threshold, it is easy to determine whether or not the floor position detection device is within the range of magnetic means. In this regard, "being in the range of magnetic means" means that a Hall effect sensor is located in a magnetic field of a magnetic means in such a manner that the magnetic field leads to a significant or measurable increase in the sensor signal and therefore the floor position characteristic value.

The floor position detection device or the evaluation unit transmits the floor signal via a communication connection to an elevator control of the elevator installation. The elevator control uses the floor signal particularly for the accurate positioning of an elevator car that can be moved in an elevator shaft on a floor or a shaft door associated to a floor. To indicate the position of a floor in a travel direction of the elevator car, at least one magnetic means is placed in the elevator shaft at a position characterizing the location of the floor. For example, the magnetic means can be arranged on the shaft door associated to the floor and the floor position detection device on the elevator car, particularly on a car door of the elevator car. This allows the elevator control to use the floor signal to position the car door and therefore the car accurately opposite the shaft door of the floor. The mentioned magnetic means may also be considered as part of the floor position detection device.

When the magnetic means is at the correct position in the elevator shaft and the floor position detection device is at the correct position on the elevator car, the "in the range of the floor" state of the floor signal shows that the elevator car is correctly positioned opposite the floor. The car door, in particular, can then be opened, which in the usual manner also opens the shaft door associated with the floor. In this case, the state "outside the range of the floor" of the floor range shows that the elevator car is not positioned in the immediate vicinity of a floor or at least not yet completely correctly opposite the floor and that in particular the car door cannot be opened.

The designations "in the range of the floor" and "outside the range of the floor" are only exemplary designations for two different states of the floor signal.

In this regard, a "floor position characteristic value" is to be understood in particular as a sensor signal or a processed sensor signal of a Hall effect sensor which is generated by the magnetic field of magnetic means. In this regard, an "evaluation unit" is to be understood in particular as an electronic unit for processing analog and/or digital electrical signals. In this regard, "is intended" is to be understood in particular as specifically equipped, laid out and/or programmed. In this regard, "magnetic means" is to be understood in particular as means for generating a magnetic field, in particular a permanent magnet in cylindrical or cuboid shape. Preferably, the two Hall effect sensors mentioned above are arranged at a known spatial distance from each other, which allows a very accurate determination of the position of the floor.

The evaluation unit can in particular be implemented as a programmable microcontroller which controls an output module, for example in the shape of a so-called high-side switch or a so-called PNP transistor. The output module then generates the floor signal transmitted to the elevator control. It is also conceivable that the floor signal is transmitted directly from the evaluation unit to the elevator control.

The individual components of the floor position detection device are arranged together in one housing, preferably in a plastic housing. The plastic housing, for example, has a length of 60-120 mm in the travel direction of the elevator car. In particular, the sensor unit can also have more than two Hall effect sensors, for example three or four Hall effect sensors. In particular, the Hall effect sensors are arranged side by side in such a manner that they have a distance from sensor center to sensor center of 20-30 mm. The Hall effect sensors are arranged in such a manner that in the mounted state of the floor position detection device they are arranged next to each other in the travel direction of the elevator car. The floor position detection device and the magnetic means are arranged in such a manner that the Hall effect sensors have a distance perpendicular to the travel direction of the elevator car of, for example, 5-25 mm to the magnetic means.

The first Hall effect sensor and the second Hall effect sensor are arranged in such a manner that, when approaching a floor, the approach can be derived from the first floor position characteristic value before the second floor position characteristic value. This means that when the floor position detection device approaches a floor and therefore magnetic means, the first floor position characteristic value rises before the second floor position characteristic value and thus shows immersion in a magnetic field. The two Hall effect sensors are arranged in such a manner that the first Hall effect sensor is immersed in the magnetic field of the magnetic means before the second Hall effect sensor.

The evaluation unit is also intended to assign to the floor signal the state "in the range of the floor" if the second floor position characteristic value is greater than or equal to the first floor position characteristic value and at the same time the first and/or second floor position characteristic value, in particular the second floor position characteristic value, is greater than the mentioned first threshold value. The first threshold value is selected in such a manner that the floor position characteristic value is only greater than the first threshold value if the corresponding Hall effect sensor is located in the range of the magnetic means, i. e. the floor position characteristic value has risen above the first threshold value as a result of the approach to the magnetic means.

In the described arrangement of the first and second Hall effect sensors, the second floor position characteristic value becomes equal to or greater than the first floor position characteristic value when the magnetic means is located between the two Hall effect sensors. The position of the floor position detection device in relation to the magnetic means and therefore opposite a floor can be determined very accurately. The comparison of the two floor position characteristic values can, however, only provide a meaningful result if at least one of the two Hall effect sensors is located in the range of magnetic means. If a Hall effect sensor is not within the range of magnetic means, the floor position characteristic value it supplies randomly fluctuates by a so-called quiescent level. If two floor position characteristic values that fluctuate randomly around the quiescent levels are compared with each other, the result of the comparison is also random and cannot be used to generate the floor signal. The further condition that the first and/or second floor position characteristic value must be greater than the first threshold value, in addition to the comparison of the two floor position characteristic values, ensures that the floor signal is only assigned the state "in the range of the floor" if the first and/or second Hall effect sensor and therefore the floor position detection device is located in the range of magnetic means.

The described quiescent level of the Hall effect sensors can also be used to specify the first threshold value. For example, the first threshold value can be set to a multiple, such as three to five times of the quiescent level of the corresponding Hall effect sensor. The quiescent level can be fixed for a certain type of Hall effect sensor, measured during production of the floor position detection device or determined after installation of the floor position detection device in an elevator installation in a so-called learning travel. For example, the first threshold value can be between 20 and 40 mV when the Hall effect sensor is supplied with 2 V.

The above-mentioned object is also solved by a method according to the invention for generating a floor signal in an elevator installation. The floor signal can assume two states "in the range of the floor" or "outside the range of the floor". A first floor position characteristic value is generated by a first Hall effect sensor and a second floor position characteristic value is generated by a second Hall effect sensor of a sensor unit, wherein the first Hall effect sensor and the second Hall effect sensor are arranged in such manner that, when approaching a floor, the approach can be derived from the first floor position characteristic value before the second floor position characteristic value. The floor signal is generated by an evaluation unit based on a comparison of the first and second floor position characteristic values. According to the invention, the evaluation unit verifies whether the first and/or second floor position characteristic value is greater than a first threshold value and generates the floor signal based on the result of the mentioned verification. The evaluation unit assigns the state "in the range of the floor" to the floor signal if the second floor position characteristic value is greater than or equal to the first floor position characteristic value and the first floor position characteristic value and/or the second floor position characteristic value is greater than the first threshold value.

The explanations and further attributes of the floor position detection device according to the invention also apply analogously to the method according to the invention.

In the design of the invention, the evaluation unit is intended to post-process a first sensor signal of the first Hall effect sensor and/or a second sensor signal of the second Hall effect sensor in order to determine the first and/or second floor position characteristic value. This enables a particularly high accuracy of the floor position detection device. Post-processing can take the shape of filtering, for example a low-pass filter.

The evaluation unit is particularly intended to calibrate the first and/or second sensor signal. In this regard, it should be understood that the two sensor signals are converted into floor position characteristic values in such a manner that both floor position characteristic values have the same maximum value. Different Hall effect sensors can output different sensor signals even at the same distance from the same magnetic means and therefore the same magnetic field. The Hall effect sensors can therefore exhibit a so-called scattering. This scattering is compensated by the described post-processing. Therefore, it can be ensured that even with different floor position detection devices, the floor signal is always assigned the state "in the range of the floor" at almost exactly the same position of the floor position detection device opposite the magnetic means and therefore opposite the floor.

In particular, the sensor signals are calibrated by storing a so-called calibration factor or amplification factor associated to a Hall effect sensor in the evaluation unit. To calculate the floor position characteristic value from the sensor signal of the Hall effect sensor, the evaluation unit multiplies the value of the sensor signal by the calibration factor. This multiplication can also be realized in an analog circuit. For example, the calibration factors can be selected so that both floor position characteristic values have the same specified maximum value. This maximum value can be 200-400 mV, for example, when the Hall effect sensors are supplied with 2 V. Determining the calibration factors is designated here as "calibration".

The described calibration can, for example, be carried out after the installation of the floor position detection device in an elevator installation during a so-called learning travel. The elevator car is moved slowly in the elevator shaft having the floor position detection device arranged on it. The floor position detection device passes magnetic means and the evaluation unit detects the sensor signals of the Hall effect sensors. It can determine the maximum sensor signals of the individual Hall effect sensors and carry out the calibration as described. It is also possible that information from another position detection system, for example an absolute position detection system, is evaluated during a learning travel.

Calibration can also be carried out directly during production of the floor position detection device. For example, the same magnetic means can be arranged one after the other at the same distance from the Hall effect sensors, wherein the evaluation unit determines the maximum sensor signal. Subsequently, the evaluation unit can carry out the calibration as described. It is also possible that two similar magnetic means, which generate the same magnetic field, are arranged simultaneously at the same distance in front of the Hall effect sensors and the evaluation unit therefore generates the maximum sensor signals.

In the design of the invention, the evaluation unit is intended to assign a specifiable time span to the floor signal after a change from the state "outside the range of the floor" to the state "in the range of the floor" and back to the state "outside the range of the floor". The floor signal therefore has only one flank if the second floor position characteristic value becomes greater than or equal to the first floor position characteristic value and the first floor position characteristic value and/or the second floor position characteristic value is greater than the first threshold. Therefore, only two Hall effect sensors are advantageously required, which enables a particularly cost-effective and space-saving embodiment of the floor position detection device. This design may be advantageous, for example, if the floor position detection device is intended to replace an older floor position detection device that generates such a floor signal. For example, the mentioned time span can have a duration between 1 and 100 ms, in particular 10 ms.

In the design of the invention, the sensor unit has a third Hall effect sensor for generating a third floor position characteristic value, which is arranged opposite the second Hall effect sensor in such a manner that, when moving away from one floor, the moving away can be derived from the second floor position characteristic value before the third floor position characteristic value. This means that when the floor position detection device moves away from a floor and therefore from magnetic means, the second floor position characteristic value falls before the third floor position characteristic value. The two Hall effect sensors are therefore arranged in such a manner that the second Hall effect sensor moves away from the magnetic field of the magnetic means before the third Hall effect sensor. The evaluation unit is also intended to assign the state "outside the range of the floor" to the floor signal on the basis of the state "in the range of the floor" if the third floor position characteristic value is greater than the second floor position characteristic value and the second and/or third floor position characteristic value is greater than a second threshold value.

Therefore, with only one additional Hall effect sensor, it can be reliably and accurately detected when the floor position detection device and therefore the elevator car move away again from magnetic means and therefore from a floor. The floor position detection device is therefore particularly cost-effective.

In particular, it is verified whether the second floor position characteristic value is greater than the second threshold value. In particular, the second threshold value may be the same as the first threshold value. For the generation of the third floor position characteristic value from the third sensor signal of the third Hall effect sensor, the same applies as for the generation of the first and second floor position characteristic value.

In the design of the invention, the sensor unit includes a third Hall effect sensor for generating a third floor position characteristic value and a fourth Hall effect sensor for generating a fourth floor position characteristic value. The third Hall effect sensor and the fourth Hall effect sensor are arranged in such a manner that when moving away from a floor, the moving away can be derived from the third floor position characteristic value before the fourth floor position characteristic value. The evaluation unit is intended to assign the state "outside the range of the floor" to the floor signal if the fourth floor position characteristic value is greater than the third floor position characteristic value and the third and/or fourth floor position characteristic value is greater than a third threshold value.

Therefore, the range in which the floor signal has the state "in the range of the floor" when passing magnetic means and therefore a floor can be set very flexibly. It can, for example, be set so that the mentioned range has a length of 20-30 mm. Flexibility is achieved by assigning the state "in the range of the floor" as a function of the first and second floor position characteristic values and resetting it to the state "outside the range of the floor" as a function of the third and fourth floor position characteristic values. Setting and resetting are independent of each other.

In particular, it is verified whether the third floor position characteristic value is greater than the third threshold value. In particular, the third threshold value may be equal to the first and/or second threshold value. For the generation of the third and fourth floor position characteristic values from the third and fourth sensor signals of the third and fourth Hall effect sensors, the same applies as for the generation of the first and second floor position characteristic values. In particular, there is also post-processing, in particular the sensor signals are calibrated.

In the design of the invention, the evaluation unit is intended to automatically perform a calibration if all sensor signals are greater than a fourth threshold value.

Due to the automated carrying out of the calibration, the evaluation unit does not have to have an input interface with which a calibration can be started. Therefore, the evaluation unit is simple and cost-effective to realize.

To carry out the calibration, for example, four similar magnetic means, i.e. magnetic means having the same magnetic field, can be arranged at the same distance from each of the four Hall effect sensors to complete the production of the floor position detection device. The distance is selected so that all four sensor signals are reliably greater than the fourth threshold value. If this condition is fulfilled, the evaluation unit automatically carries out a calibration. A calibration factor is determined for each Hall effect sensor, by which the respective sensor signal is multiplied when the floor position characteristic value is generated. The calibration factors are determined so that all floor position characteristic values have the same maximum value. It would also be possible to determine the calibration factors in such a manner that only the first and second as well as the third and fourth floor position characteristic values each have the same maximum values.

In particular, the fourth threshold value may be equal to the first, second and/or third threshold value.

If the fourth threshold is specified correctly, it will never happen that all four floor position characteristic values are greater than the fourth threshold value during real operation of the floor position detection device in an elevator installation. It is therefore impossible for a new calibration to be carried out in real operation.

In the design of the invention, the floor position detection device has a power supply unit which supplies the Hall effect sensors and the evaluation unit with the same supply voltage. Therefore, a simple and cost-effective power supply unit can be used.

The mentioned supply voltage can be, for example, between 1 and 4 V, in particular 2 V.

The output module can be supplied with a different supply voltage, in particular a higher supply voltage of, for example, 24 V.

The floor position detection device according to the invention and an elevator control are components of an elevator control system of an elevator installation. The elevator control system comprises in particular other sensors and actuators and is used to control the entire elevator installation.

Additional advantages, features, and details of the invention result using the following description of embodiment examples and using drawings in which the same or functionally identical elements are provided having identical reference signs.

DESCRIPTION OF THE DRAWINGS

In which.

DETAILED DESCRIPTION

Figure 1:
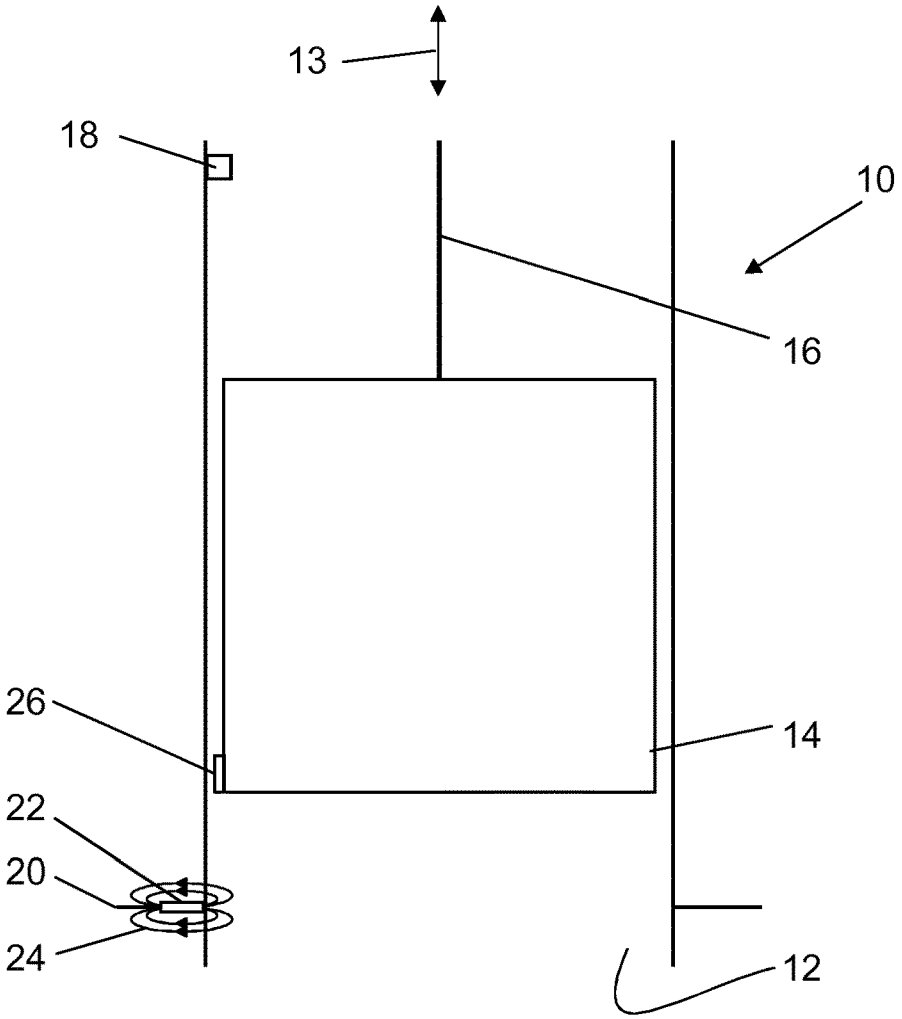
FIG. 1 is a part of an elevator installation having an elevator car, on which a floor position detection device is arranged, in an elevator shaft.

According to FIG. 1, an elevator installation 10 has an elevator car 14 movable in an elevator shaft 12. The elevator car 14 is suspended in the shape of a rope or a belt by carrying means 16 and can be driven up and down in the lift elevator shaft 12, i.e. in one travel direction 13, by means of an unrepresented drive machine. The elevator installation 10 is controlled by an elevator control 18, which, among other things, has a signal connection with the drive machine via unrepresented communication connections.

In the elevator shaft 12, magnetic means 22 in the shape of a permanent magnet is arranged at a location 20 that characterizes a floor. The magnetic means 22 is surrounded by a magnetic field 24, which is symbolically represented by some magnetic field lines. The magnetic means 22 characterizes the floor in the vertical direction, i.e. in the travel direction 13 of the elevator car 14. For example, it can be arranged on a shaft door that is not represented.

Figure 2:
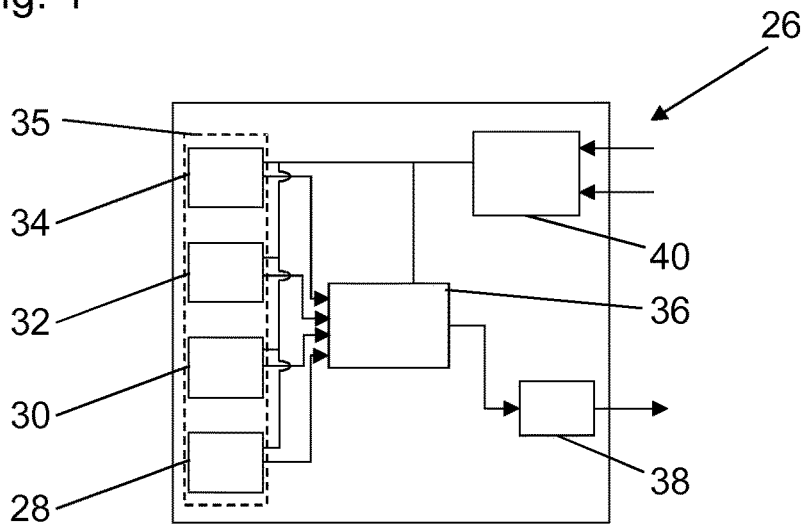
FIG. 2 is a schematic representation of a floor position detection device.

A floor position detection device 26 is arranged on the elevator car 14, which is in communication connection with the elevator control 18 and whose structure is represented in more detail in FIG. 2. The floor position detection device 26 is arranged on the elevator car 14 in such a manner that it has a horizontal distance between 5 and 25 mm to the magnetic means 22 when passing the magnetic means 22. The floor position detection device 26 can be arranged, for example, on a car door that is not represented.

The floor position detection device 26 and the elevator control 18 are components of an elevator control system of the elevator installation 10. The elevator control system comprises in particular other sensors and actuators that are not represented.

According to FIG. 2, the floor position detection device 26 has a first Hall effect sensor 28, a second Hall effect sensor 30, a third Hall effect sensor 32 and a fourth Hall effect sensor 34 arranged side by side. The four Hall effect sensors 28, 30, 32 and 34 form a sensor unit 35. When the floor position detection device 26 is located on the elevator car 14, the four Hall effect sensors 28, 30, 32, 34 are arranged side by side in the travel direction 13 in such a manner that they all have the same horizontal distance to the magnet means 22.

Sensor signals of the four Hall effect sensors 28, 30, 32, 34 are forwarded to an evaluation unit 36, which is implemented as a programmable microprocessor. The evaluation unit 36 first calculates four floor position characteristic values from the sensor signals mentioned and links them to a floor signal, which passes them to an output module 38. The output module 38 amplifies the floor signal and forwards it to the elevator control 18. Progressions of the floor position characteristic values and the floor signal are represented in FIG. 3.

To calculate the floor position characteristic values, the evaluation unit 36 calibrates the sensor signals of the four Hall effect sensors 28, 30, 32, 34. For this purpose, the evaluation unit 36 multiplies each sensor signal by a corresponding calibration factor. The calibration factors are determined during a calibration of the floor position detection device 26 to complete production of the floor position detection device 26. For this purpose, one of each four identical magnetic means is arranged at a fixed distance in front of the four Hall effect sensors 28, 30, 32, 34. The mentioned distance is selected so that each of the four sensor signals of the four Hall effect sensors 28, 30, 32, 34 safely exceeds a fourth threshold value. As soon as the evaluation unit 36 detects that all four sensor signals are greater than the fourth threshold value, it automatically starts a calibration. The calibration factors are determined in such a manner that during calibration each floor position characteristic value resulting from the multiplication of the sensor signal with the corresponding calibration factor has the same value of, for example, 300 mV.

The floor position detection device 26 also has a power supply unit 40, which supplies the four Hall effect sensors 28, 30, 32, 34, the evaluation unit 36 and the output module 38 with a supply voltage. The power supply unit 40 supplies the four Hall effect sensors 28, 30, 32, 34 and the evaluation unit 36 with the same 2 V supply voltage and the output module 38 with a different 24 V supply voltage. The power supply unit 40 and therefore the floor position detection device 26 are supplied with an input voltage of 24 V for this purpose.

Figure 3:
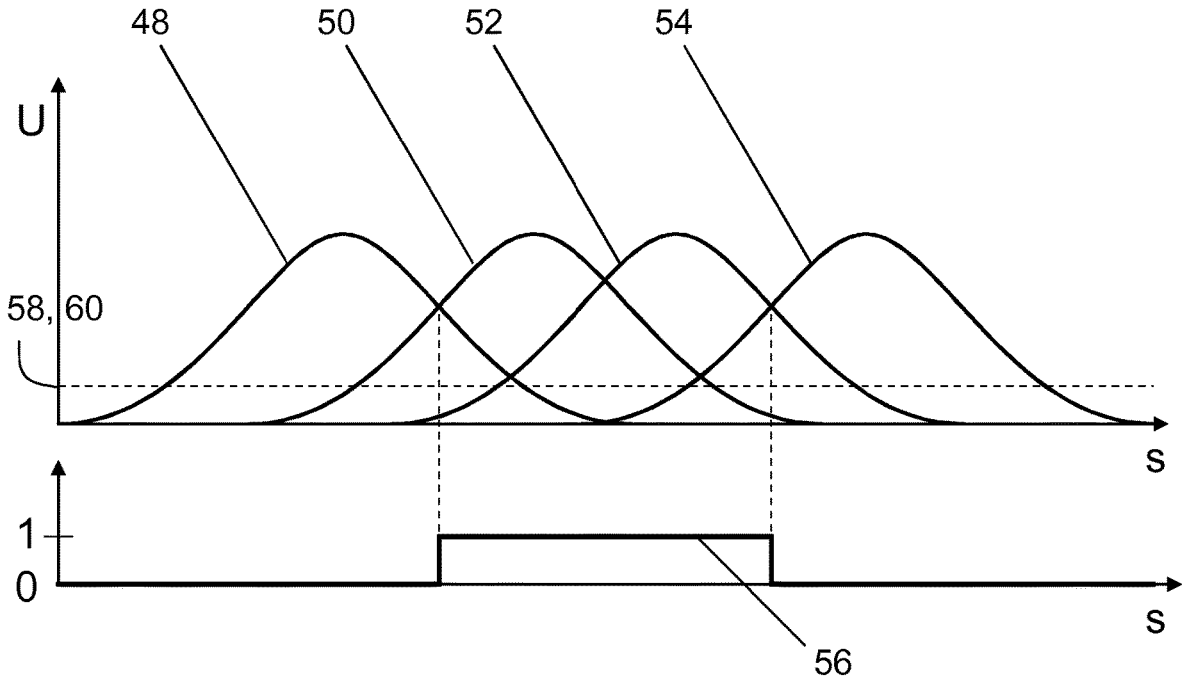
FIG. 3 is the progression of floor position characteristic values and a floor signal when an elevator car having one of the floor position detection devices according to FIG. 2 passes magnetic means characterizing a floor.

In FIG. 3, the progressions of floor position characteristic values, as well as of a floor signal when passing the magnetic means 22 of the elevator car 14 and therefore of the floor position detection device 26 are from top to bottom. Curve 48 shows the first floor position characteristic value of the first Hall effect sensor 28, curve 50 shows the second floor position characteristic value of the second Hall effect sensor 30, curve 52 shows the third floor position characteristic value of the third Hall effect sensor 32 and curve 54 shows the fourth floor position characteristic value of the fourth Hall effect sensor 34. Curve 56 shows the progression of the floor signal. The floor signal 56 can assume the state "outside the range of the floor" and "in the range of the floor", wherein in FIG. 3 the state "outside the range of the floor" is characterized with "0" and the state "in the range of the floor" with "1".

The floor position characteristic values 48, 50, 52 and 54 rise from a quiescent level when the Hall effect sensor in question 28, 30, 32 and 34 enters the range of the magnetic means 22, i.e. is immersed in the magnetic field 24. They reach their maximum when the Hall effect sensor 28, 30, 32 and 34 in question is accurately at the level of the magnetic means 22, to sink back to the quiescent level when moving away from the magnetic means 22. From the size of the associated floor position characteristic values 48, 50, 52 and 54, therefore, the distance of the corresponding Hall effect sensor 28, 30, 32, 34 from the magnetic means 22 in travel direction 13 can be inferred.

The first Hall effect sensor 28 and the second Hall effect sensor 30 are arranged in such a manner that when the floor position detection device 26 approaches the magnetic means 22 and therefore one floor, the approach can be derived from the first floor position characteristic value 48 before the second floor position characteristic value 50. This can be seen from the fact that the first floor position characteristic value 48 rises before the second floor position characteristic value 50. The evaluation unit 36 assigns the floor signal 56 the state "in the range of the floor" starting from the state "outside the range of the floor" if the second floor position characteristic value 50 becomes larger than the first floor position characteristic value 48 and at the same time the second floor position characteristic value 50 is larger than a first threshold value 58.

The third Hall effect sensor 32 and the fourth Hall effect sensor 34 are arranged in such a manner that when the floor position detection device 26 moves away from the magnetic means 22 and therefore from one floor, the moving away from the third floor position characteristic value 52 can be derived before the fourth floor position characteristic value 54. This can be seen from the fact that the third floor position characteristic value 52 decreases before the fourth floor position characteristic value 54 after reaching the maximum. The evaluation unit 36 then assigns the state "outside the range of the floor" to the floor signal 56 starting from the state "in the range of the floor" if the fourth floor position characteristic value 54 becomes larger than the third floor position characteristic value 52 and at the same time the third floor position characteristic value 52 is larger than a second threshold value 60 which is identical with the first threshold value 58.

The magnetic means 22 and the floor position detection device 26 are arranged in such a manner that the floor signal has the state "in the range of the floor" when the elevator car 14 is positioned opposite a floor in such a manner that the car door and therefore also the shaft door can be opened at the same time.

The numbering used for the Hall effect sensors and therefore for the floor position characteristic values applies from top to bottom when passing the magnetic means as described above. When passing from bottom to top, the numbering is reversed. It is also possible that the floor position detection device has only three Hall effect sensors instead of four. In this case, the evaluation unit assigns the condition "outside the range of the floor" to the floor signal based on the state "in the range of the floor" as a function of the second and third floor position characteristic value. The evaluation unit evaluates the second floor position characteristic value for the third floor and the third for the fourth floor position characteristic value.

Figure 4:
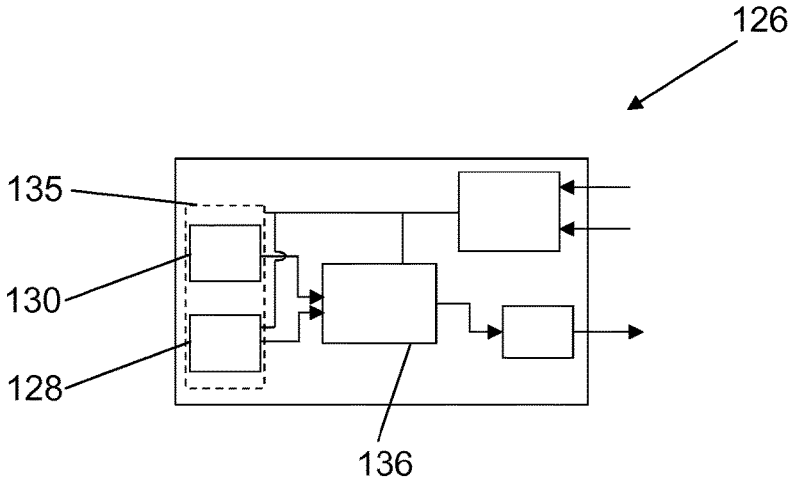
FIG. 4 is a schematic representation of an alternative floor position detection device and FIG. 5 is the progression of floor position characteristic values and a floor signal when an elevator car having one of the floor position detection devices according to FIG. 4 passes magnetic means characterizing a floor.

In FIG. 4 an alternative floor position detection device 126 to the floor position detection device 26 from FIG. 2 is represented. The floor position detection device 126 has a similar structure to the floor position detection device 26, so that only the differences between the two floor position detection devices are dealt with. Similar or equivalent component parts are characterized in FIG. 4 with a reference sign that is bigger by 100 as in FIG. 2.

The sensor unit 135 of the floor position detection device 126 has only a first Hall effect sensor 128 and a second Hall effect sensor 130, which are also arranged side by side.

An evaluation unit 136 determines a floor signal from the sensor signals of the two Hall effect sensors 128, 130. Progressions of the floor position characteristic values and the floor signal are represented in FIG. 5.

Figure 5:
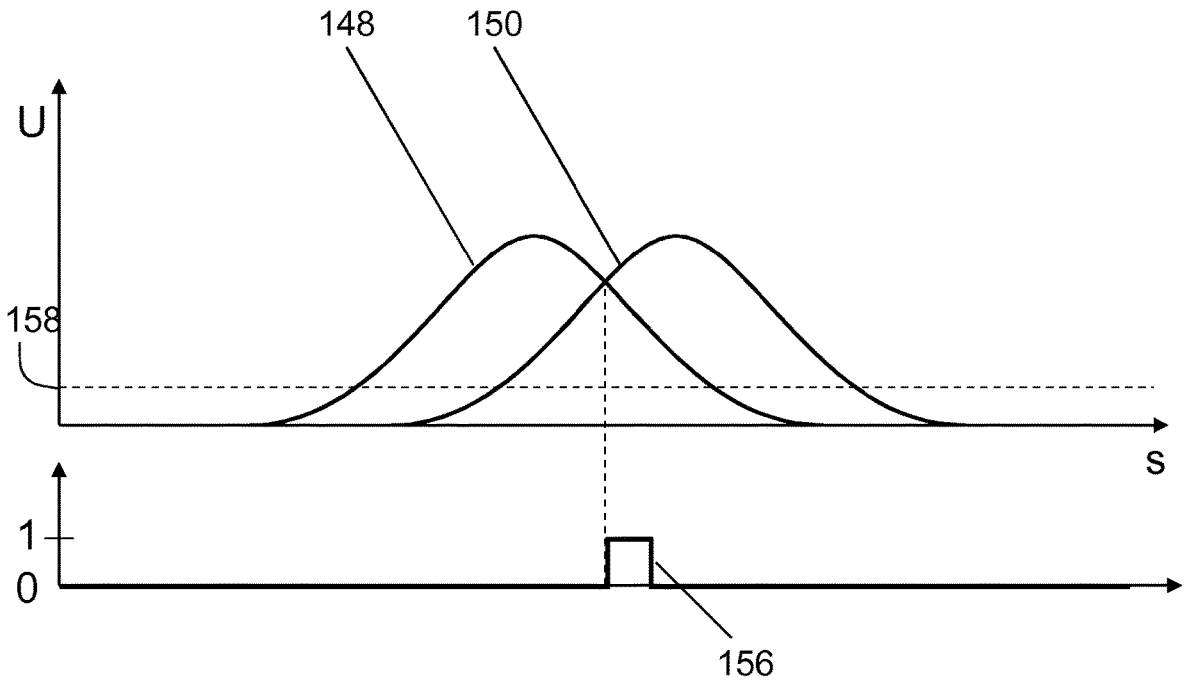

In FIG. 5 the progression of floor position characteristic values, as well as of a floor signal when passing the magnetic means 22 of the elevator car 14 and therefore of the floor position detection device 126 are from top to bottom. The curve 148 shows the first floor position characteristic value of the first Hall effect sensor 128 and the curve 50 the second floor position characteristic value of the second Hall effect sensor 130. The curve 156 shows the progression of the floor signal. The floor signal 156 can assume the state "outside the range of the floor" and "in the range of the floor", wherein in FIG. 5 the state "outside the range of the floor" is characterized with "0" and the state "in the range of the floor" with "1".

The floor position characteristic values 148 and 150 rise from a quiescent level each time the Hall effect sensor 128, 130 in question enters the range of the magnetic means 22, i.e. is immersed in the magnetic field 24. They reach their maximum when the Hall effect sensor 128, 130 in question is accurately at the height of the magnetic means 22, to sink back to the quiescent level when moving away from the magnetic means 22. From the size of the associated floor position characteristic value 148, 150, therefore, the distance of the corresponding Hall effect sensor 128, 130 from the magnetic means 22 in travel direction 13 can be inferred.

The first Hall effect sensor 128 and the second Hall effect sensor 130 are arranged in such a manner that when the floor position detection device 126 approaches the magnetic means 22 and therefore a floor, the approach can be derived from the first floor position characteristic value 148 before the second floor position characteristic value 150. This can be seen from the fact that the first floor position characteristic value 148 rises before the second floor position characteristic value 150. The evaluation unit 136 assigns the floor signal 156 the state "in the range of the floor" starting from the state "outside the range of the floor" if the second floor position characteristic value 150 becomes larger than the first floor position characteristic value 148 and at the same time the second floor position characteristic value 150 is larger than a first threshold value 158. After the expiry of a specifiable time span of, for example, 1 and 100 ms, in particular 10 ms, after the described change of the floor signal 156 from the state "outside the range of the floor" to the state "in the range of the floor", the evaluation unit 136 resets the floor signal 156 to the state "outside the range of the floor".

The numbering used for the Hall effect sensors and therefore for the floor position characteristic values applies from top to bottom when passing the magnetic means as described above. When passing from bottom to top, the numbering is reversed.

Finally, it should be noted that terms such as "have", "comprising", etc. do not exclude any other elements or steps and terms such as "an" or "a" do not exclude any plurality. Further, it should be noted that features or steps which have been described with reference to one of the above embodiment examples can also be used in combination with other features or steps of other embodiment examples described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A floor position detection device for an elevator installation, the floor position detection device having a sensor unit and an evaluation unit for generating a floor signal that has two states, the states being "in the range of the floor" or "outside the range of the floor", comprising:

the sensor unit having a first Hall effect sensor generating a first floor position characteristic value and a second Hall effect sensor generating a second floor position characteristic value;

the evaluation unit generating the floor signal based on a comparison of the first floor position characteristic value and the second floor position characteristic value;

wherein the first Hall effect sensor and the second Hall effect sensor are arranged such that, when the sensor unit approaches a floor in the elevator installation, the approach can be derived by the evaluation unit from the first floor position characteristic value being generated before the second floor position characteristic value;

wherein the evaluation unit verifies whether the first floor position characteristic value and/or the second floor position characteristic value is greater than a first threshold value;

wherein the evaluation unit generates the floor signal to an elevator control of the elevator installation based on a result of the verification; and wherein the evaluation unit assigns to the floor signal the state "in the range of the floor" when the second floor position characteristic value is greater than or equal to the first floor position characteristic value and the first floor position characteristic value and/or second floor position characteristic value is greater than the first threshold value.

2. The floor position detection device according to claim 1 wherein the evaluation unit assigns the state "in the range of the floor" to the floor signal if the second floor position characteristic value is greater than the first threshold value.

3. The floor position detection device according to claim 1 wherein the evaluation unit performs post-processing on a first sensor signal generated by the first Hall effect sensor for determining the first floor position characteristic value and/or a second sensor signal generated by the second Hall effect sensor for determining the second floor position characteristic value.

4. The floor position detection device according to claim 3 wherein the evaluation unit calibrates the first sensor signal and/or second sensor signal.

5. The floor position detection device according to claim 1 wherein the evaluation unit assigns the state to the floor signal a predetermined time after a change from the state "outside the range of the floor" to the state "in the range of the floor" and back to the state "outside the range of the floor".

6. The floor position detection device according to claim 1 wherein the sensor unit has a third Hall effect sensor generating a third floor position characteristic value, which third Hall effect sensor is arranged opposite the second Hall effect sensor such that, when the sensor unit moves away from a floor, the moving away can be derived from the second floor position characteristic value before the third floor position characteristic value, and wherein the evaluation unit assigns to the floor signal the state "outside the range of the floor" if the third floor position characteristic value is greater than the second floor position characteristic value and the second floor position characteristic value and/or third floor position characteristic value is greater than a second threshold value.

7. The floor position detection device according to claim 6 wherein the evaluation unit calibrates the third sensor signal.

8. The floor position detection device according to claim 7 wherein the evaluation unit automatically calibrates if all of the sensor signals are greater than a third threshold value.

9. The floor position detection device according to claim 1 wherein the sensor unit has a third Hall effect sensor generating a third floor position characteristic value and a fourth Hall effect sensor generating a fourth floor position characteristic value, and the third Hall effect sensor and the fourth Hall effect sensor are arranged such that, when the sensor unit is moving away from a floor, the moving away can be derived from the third floor position characteristic value being generated before the fourth floor position characteristic value, and wherein the evaluation unit assigns to the floor signal the state "outside the range of the floor" if the fourth floor position characteristic value is greater than the third floor position characteristic value and the third floor position characteristic and/or fourth floor position characteristic value is greater than a third threshold value.

10. The floor position detection device according to claim 9 wherein the evaluation unit calibrates the third sensor signal and/or the fourth sensor signal.

11. The floor position detection device according to claim 10 wherein the evaluation unit automatically calibrates if all of the sensor signals are greater than a fourth threshold value.

12. The floor position detection device according to claim 1 including a voltage supply unit connected to supply the Hall effect sensors and the evaluation unit with a same supply voltage.

13. An elevator control system for an elevator installation comprising an elevator control connected to the floor position detection device according to claim 1.

14. An elevator installation comprising the elevator control system according to claim 13 controlling movement of an elevator car.

15. A method for generating a floor signal in an elevator installation, wherein the floor signal can assume two states being "in the range of the floor" and "outside the range of the floor", the method comprising the steps of:

generating a first floor position characteristic value from a first Hall effect sensor of a sensor unit and generating a second floor position characteristic value from a second Hall effect sensor of the sensor unit;

generating the floor signal from an evaluation unit based on a comparison of the first floor position characteristic value and the second floor position characteristic value;

wherein the first Hall effect sensor and the second Hall effect sensor are arranged such that, when the sensor unit is approaching a floor in the elevator installation, the approach can be derived by the evaluation unit from the first floor position characteristic value being generated before the second floor position characteristic value;

wherein the evaluation unit verifies whether the first floor position characteristic value and/or second floor position characteristic value is greater than a first threshold value;

wherein the evaluation unit generates the floor signal based on a result of the verification; and wherein the evaluation unit assigns to the floor signal the state "in the range of the floor", if the second floor position characteristic value is greater than or equal to the first floor position characteristic value and the first floor position characteristic value and/or second floor position characteristic value is greater than the first threshold value.

* * * * *